United States Patent [19]

Nonomura et al.

[11] Patent Number: 4,586,039

[45] Date of Patent: Apr. 29, 1986

[54] LIQUID CRYSTAL DISPLAY DEVICE AND METHOD FOR DRIVING THEREOF

[75] Inventors: Keisaku Nonomura, Nara; Fumiaki Funada, Yamatokoriyama; Masataka Matsuura, Tenri, all of Japan

[73] Assignee: Sharp Kabushiki Kaisha, Osaka, Japan

[21] Appl. No.: 489,276

[22] Filed: Apr. 26, 1983

[30] Foreign Application Priority Data

Apr. 26, 1982 [JP] Japan ..... 57-70820

[51] Int. Cl.[4] ..... G09G 3/36

[52] U.S. Cl. ..... 340/784; 340/813; 340/719

[58] Field of Search ..... 340/784, 765, 813, 802, 340/783, 789, 718, 719

[56] References Cited

U.S. PATENT DOCUMENTS

| | | | |
|---|---|---|---|
| 3,976,362 | 8/1976 | Kawakami | 340/784 |
| 4,045,791 | 8/1977 | Fukai et al. | 340/784 |
| 4,242,679 | 12/1980 | Morozumi et al. | 340/813 |
| 4,257,045 | 3/1981 | Miles | 340/784 |
| 4,298,866 | 11/1981 | Hodemaekers | 340/784 |
| 4,404,555 | 9/1983 | Long et al. | 340/784 |
| 4,462,027 | 7/1984 | Lloyd | 340/784 |

*Primary Examiner*—Gerald L. Brigance

*Attorney, Agent, or Firm*—Birch, Stewart, Kolasch & Birch

[57] ABSTRACT

A liquid crystal display device includes a field effect transistor array substrate (22) and a counter substrate (23). The field effect transistor array substrate (22) carries FETs (3), capacitors (5) and one electrode of the liquid crystal element deposited on a glass support (7). The counter substrate (23) carries a common electrode (31) in a form of stripes which extend parallel to the gate electrodes (8), and are deposited on another glass support (7'). The substrates are bonded together via a sealing member (21) and a suitable liquid crystal material (16) is injected therebetween. The device further includes a detecting circuit (33) for detecting a voltage produces at the drain electrode (6), a discriminator (34) for discriminating whether the voltage detected by the detecting circuit (33) is above or below a predetermined voltage, and a frame frequency adjusting circuit (35). When the detected voltage is higher than a predetermined potential, the adjusting circuit (35) increases the frame frequency, resulting in decrease of the write-in or coloration voltage. When the detected voltage is lower than the predetermined potential, the adjusting circuit (35) decreases the frame frequency, resulting in increase of the write-in voltage. Thus, the voltage applied to the liquid crystal (16) is corrected.

10 Claims, 10 Drawing Figures

LIQUID CRYSTAL DISPLAY DEVICE AND METHOD FOR DRIVING THEREOF

BACKGROUND OF THE INVENTION

1. Field of the Invention

The present invention relates to a liquid crystal display device and also to a method for driving such a liquid crystal display device. More particularly, the present invention relates to a matrix type liquid crystal display device in which each picture element of the liquid crystal cell or panel is provided with a field effect transistor (hereinafter referred to as a FET), and also to a method for driving such a matrix type liquid crystal, thereby enabling the drive by multi-line multiplex operation and providing a high contrast picture.

2. Description of the Prior Art

A matrix type liquid crystal display panel employing FETs is developed by Westinghouse Electric Co. in 1973 wherein the matrix type liquid crystal display panel has picture elements each formed by FET and thin film capacitor.

A detail of Westinghouse's matrix type liquid crystal display panel and its driving method are disclosed in IEEE Transactions on Electron Devices, Vol. ED-20, No. Nov. 11, 1973, entitled, "A 6×6 Inch 20 Lines-per-Inch Liquid-Crystal Display Panel" by T. P. Brody et al.

According to Westinghouse's matrix type liquid crystal display panel, there are following problems:

(1) In a case where a drive signal that illuminates all the picture elements other than one element selected by i(th) source electrode Si and j(th) gate electrode Gj, wherein i and j are integers, is applied, a drain of a FET provided in that one element receives an effective voltage which is equal to or above a voltage needed to turn on the FET, resulting in error display or in different contrast that varies with respect to the change of number of illuminating elements.

(2) Since the voltage-current characteristic of the FET is non-symmetric between positive and negative regions, the voltage applied to the liquid crystal has a waveform which is non-symmetric between positive and negative regions and, therefore, the liquid crystal receives a voltage having a d.c. component. This results in short life time of the liquid crystal.

In order to solve the above problems (1) and (2), there have been proposed an improved liquid crystal display panel and its driving method which are disclosed in U.S. Pat. No. 4,386,352, issued May 31, 1983 and also in U.S. Pat. No. 4,385,292, issued July 25, 1980 which are assigned to the same applicant as the present application.

SUMMARY OF THE INVENTION

The present invention has as its essential object to provide a further improved liquid crystal display device and its driving method by adding a new circuit to the liquid crystal display panel disclosed in the above mentioned U.S. Pat. Nos. 4,386,352 and 4,385,292 so as to obtain a more effective operation.

It is also an essential object of the present invention to provide liquid crystal display device and its driving method wherein a deformation of waveform of charging and discharging voltage across the picture element electrodes caused by the variability in characteristic of the FET, temperature change, and/or aging, can be corrected by the change of frame frequency.

According to the present invention, there is provided a liquid crystal display device comprising: a matrix type liquid crystal display cell which includes: a plurality of gate lines and source lines intersecting with each other; transistor array substrate including a plurality of FETs each provided at the intersection of the gate and source lines; a counter substrate having a plurality of common electrodes aligned in stripes parallel to the gate lines, the transistor array substrate and counter substrate held in a spaced relation to each other to define a cavity therebetween; and liquid crystal material filled in the cavity.

The liquid crystal display device according to the present invention further comprises means for applying a counter electrode voltage which varies between an odd frame and an even frame, to the common electrode; means for applying an a.c. voltage to the liquid crystal material of a picture element to be colored by generating a voltage, having a phase opposite to that of the counter electrode voltage, at an electrode of the picture element according to the operation of the FET; means for counterbalancing a voltage applied to the liquid crystal material in a picture element required not to be written-in, by generating a voltage having the same phase as that of the counter electrode voltage at an electrode of the picture element according to the operation of the FET; a detecting circuit for detecting a potential of the electrode of the picture element at a predetermined moment during an odd or even frame; a discriminating circuit for discriminating whether a potential detected by the detecting circuit is above or below a predetermined potential; and a circuit for adjusting frame frequency such that the frame frequency is increased or decreased based on a discrimination by the discriminating circuit.

Furthermore, according to the present invention, a method for driving the above described liquid crystal display device comprises the steps of: applying a counter electrode voltage, that varies between odd frame and even frame, to the common electrode; applying an a.c. voltage to the liquid crystal material of a picture element to be colored by generating a voltage having a phase opposite to that of the counter electrode voltage at an electrode of the picture element according to the operation of the FET; counterbalancing a voltage applied to the liquid crystal material of a picture element required not to be colored by generating a voltage having a phase which is the same as that of the counter electrode voltage at an electrode of the picture element according to the operation of the FET; detecting a characteristic change of the FET; and adjusting frame frequency based on a detected value such that a waveform of voltage generated at the electrode of picture element is made substantially the same as that of counter electrode voltage applied to the common electrode.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Before the description of the present invention proceeds, the matrix type liquid crystal display panel according to U.S. Pat. No. 4.386,352, as well as its driving method, is described with reference to FIGS. 1, 2 and 3.

Figure 1:
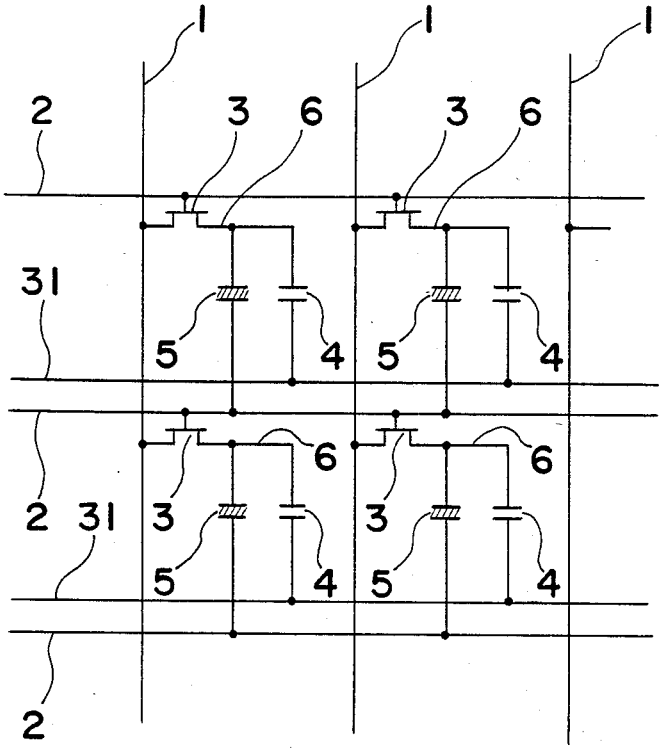
Fig. 1 PRIOR ART
FIG. 1 is a circuit equivalent to a liquid crystal cell portion of a liquid crystal display panel according to the prior art.

A liquid crystal panel used in the matrix type liquid crystal display of the prior art includes, as shown in FIG. 1, a plurality of source lines 1 extending parallel to each other, and a plurality of gate lines 2 extending parallel to each other and intercepting the source lines 1. A FET (field effect transistor) 3 is connected at each interception of the lines 1 and 2 such that the source of the FET 3 is connected to the source line 1 and the gate thereof is connected to the gate line 2. A plurality of common electrodes 31 extend parallel to the gate lines 2 with 1 gate line 2 and 1 common electrode 31 occurring alternately. A drain 6 of each FET is connected through a liquid crystal cell 4 to the common electrode 31, and also through a memory capacitor 5 to a neighboring gate line 2.

Figure 2:
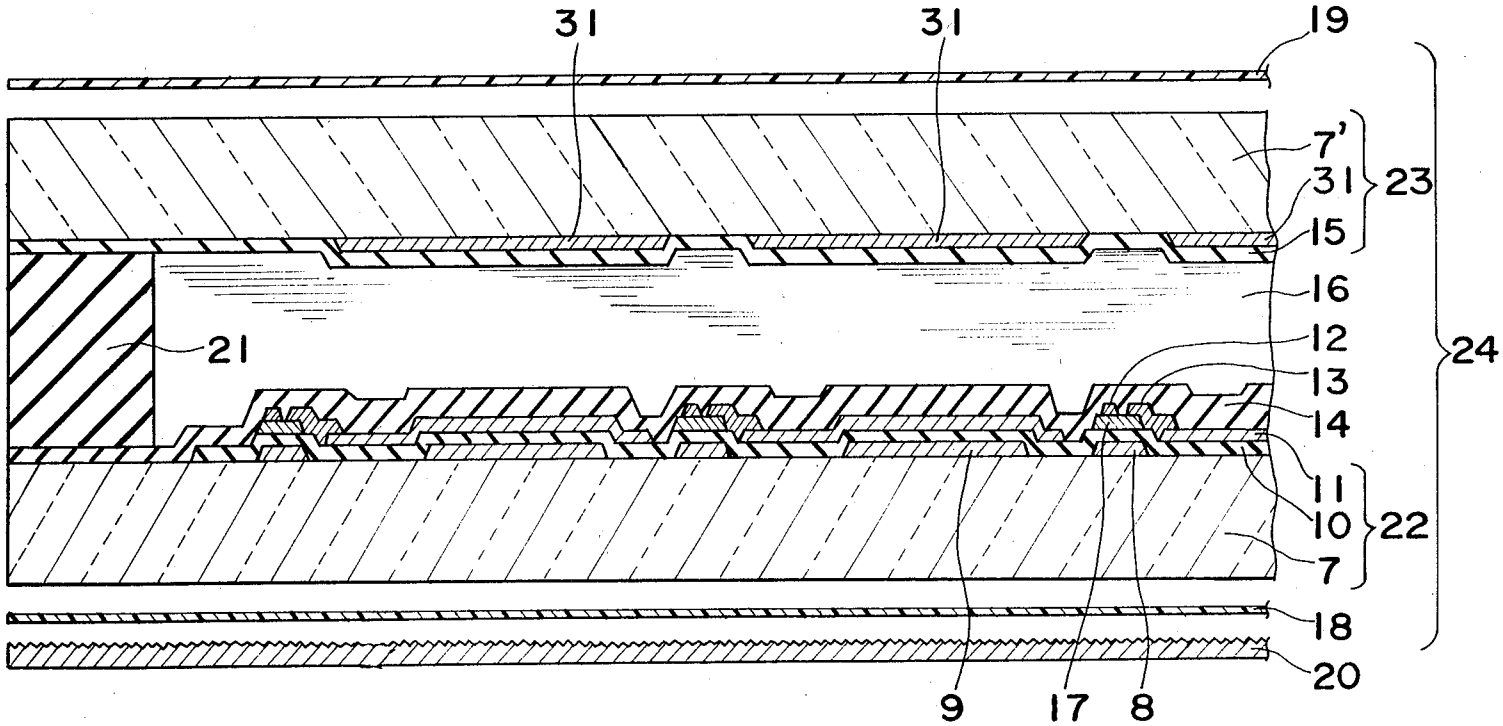
Fig. 2 PRIOR ART
FIG. 2.is a cross-sectional view of a liquid crystal cell having the circuit of FIG. 1.

The liquid crystal panel having the above described circuitry generally comprises a field effect transistor array as shown in FIG. 2 with substrate 22 and a counter substrate 23. The former carries the FET 3, the capacitor 5 and one electrode of the liquid crystal element deposited on a glass support 7 by a well known evaporation method, the electrodes being aligned with the X-Y coordinates to form X and Y leads for each of the liquid crystal unit elements. The counter substrate 23 carries a transparent and conductive film (common electrode) 31 in a form of stripes which extend parallel to the gate electrodes 8, and are deposited on another glass support 7'. Both electrode substrates are subject to a TN (twisted nematic) alignment process by way of, e.g., slant evaporation or rubbing after transparent insulating layers 14 and 15 of SiO or $SiO_2$, etc. are deposited thereon. In addition, both substrates are bonded together via a sealing member 21 and a suitable liquid crystal material 16, such as TN-FEM liquid crystal or guest host effect liquid crystal, is injected therebetween, thereby completing the fabrication of a matrix type liquid crystal display panel 24 using the FETs 3. Finally, a pair of polarizers 18 and 19 and a reflector 20 are disposed outside the matrix type liquid crystal panel, thereby completing a matrix type liquid crystal display.

In FIG. 2, 9 designates one electrode for the capacitor 5, 10 designates a layer serving as a dielectric layer for the capacitor 5 and also as a gate insulation layer for the FET 3, 12 designates a source electrode, 13 designates a drain electrode, and 17 designates a semiconductor layer.

Figure 3:
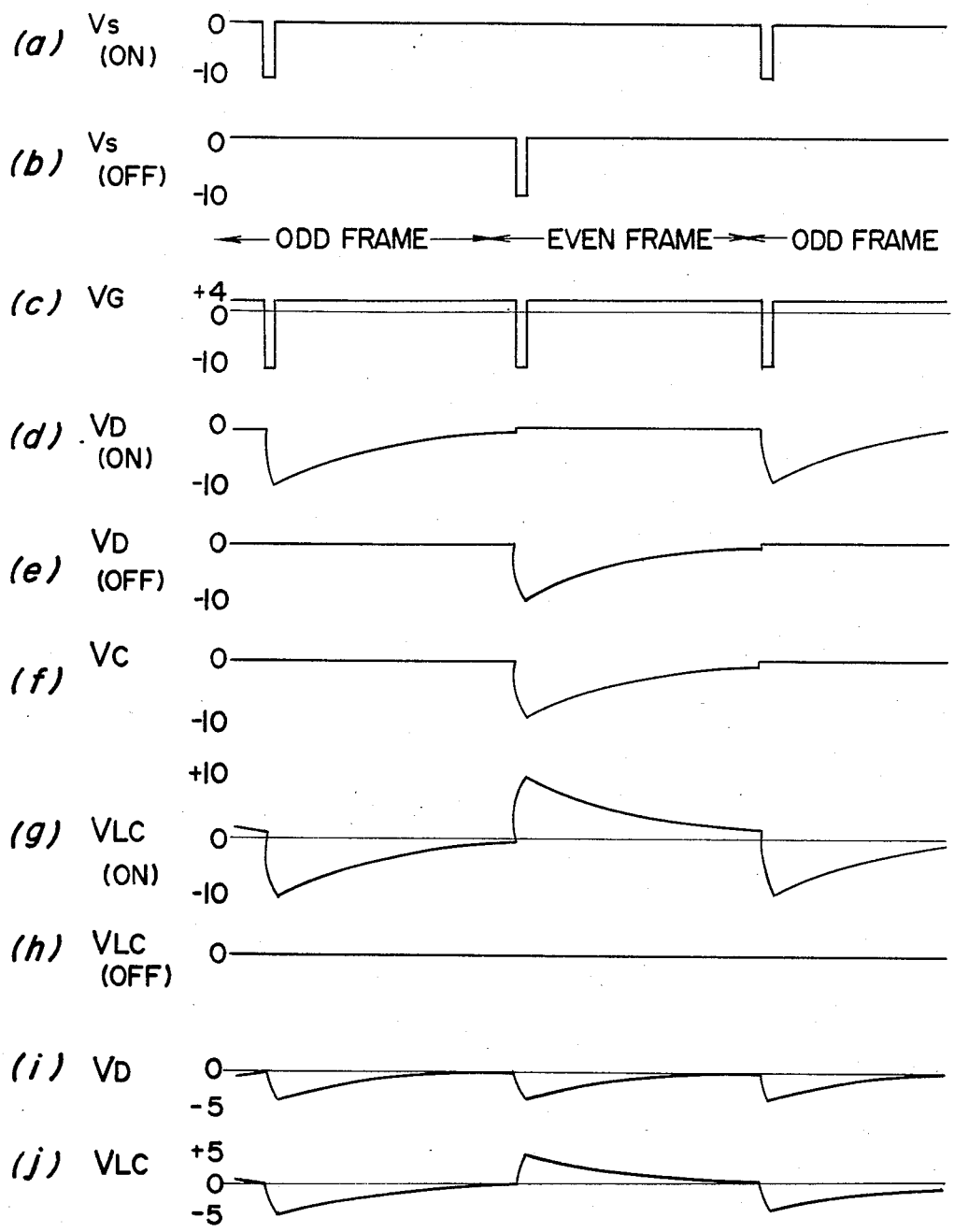
Fig. 3 PRIOR ART
FIG. 3 is a time chart for operating the liquid crystal cell having the circuit of FIG. 1.

When it is desired to write or color a selected one of the picture elements, a unidirectional source voltage pulse VS as shown in FIG. 3, row (a) is supplied to the source electrode of its associated FET 3. The source voltage pulse VS is a negative going pulse in the case where FET 3 is a P channel type, and positive in the case where FET 3 is an N channel type. The waveforms in FIG. 3 are depicted based on a case in which the FET 3 is P channel type. The gate voltage pulse $V_G$ shown in FIG. 3, row (c) is applied to turn the FET 3 on during odd frame and off during even frame. As understood from the waveforms shown in FIG. 3, rows (a) and (c), the FET 3 turns on during odd frame, and off during even frame and, therefore, the drain voltage $V_D$(ON) of the FET shows the waveform of FIG. 3, row (d). The waveform of FIG. 3, row (d) illustrates only the negative voltage side and, of course, includes a d.c. component. A common voltage $V_C$ shown in FIG. 3, row (f) is applied so as to add voltage having an opposite phase to that of the above described voltage to the liquid crystal during the even frame, from the common electrode at the other side of the selected display element. As a result, a difference voltage between the voltages of FIG. 3, rows (d) and (f), as shown by a waveform of FIG. 3, row (g), is applied across the liquid crystal material to perform the write operation. As apparent from FIG. 3, row (g), by suitably selecting the voltage value and waveform of the common voltage $V_C$ in consideration of the drain voltage $V_D$, it is possible to apply to the liquid crystal panel an alternating voltage that includes no d.c. component.

When a selected picture element of the liquid crystal material is not desired to be written-in, the source electrode of its associated FET is supplied with the source voltage pulse $V_S$ (OFF) as shown in FIG. 3, row (b) together with the gate voltage pulse $V_G$ of FIG. 3, row (c) in such a way that the FET 3 turns off during odd frames and, on during even frames. Therefore, the drain voltage $V_D$ (OFF) of the FET 3 has the waveform shown in FIG. 3, row (e), this voltage being applied to one electrode of the picture element of the liquid crystal material. The common voltage $V_C$ shown in FIG. 3, row (f) is applied to the common electrode during the even frames with the resulting similarity in voltage polarity and waveform. Therefore, there is no potential difference between the two opposing electrodes of the panel, and the voltage across non-selected picture elements, i.e., drain voltage $V_D$, is thus as indicated in FIG. 3, row (h).

As understood from the foregoing description, a method for driving the matrix type liquid crystal panel disclosed in U.S. Pat. No. 4,386,352 is such that, first, a voltage having a polarity which is the same as or opposite to that of the signal at the common electrode 31 is applied to the drain electrode 6 of the FET 3, and then, by the phase difference therebetween, the liquid crystal cell 4 is either actuated or de-actuated. In order to eliminate d.c. component from the alternating voltage applied to the liquid crystal cell 4, and to eliminate voltage from the liquid crystal during the off-period it is necessary to render the waveforms of the voltage appearing at the drain electrode 6 and voltage appearing at the common electrode 31 exactly the same to each other. If, for some reason or other, the characteristic of the FET 3 changes, the voltage appearing at the drain electrode 6 also changes.

The reason for this is that the waveforms of the charging and discharging voltages at the drain electrode 6 of the FET 3 are determined by the following equations (1) and (2):

$$V_{D1}=V_0(1-e^{-t/\tau 1}) \quad (1)$$

$$V_{D2}=V_1 \cdot e^{-t/\tau 2}, \quad (2)$$

wherein $\tau 1=R_{ON} \cdot C_S$, $\tau 2=R_{OFF} \cdot C_S$, and $V_1=V_0(1-e^{T_{ON}/\tau 1})$.

As apparent from the above equations (1) and (2), the waveforms of the charging and discharging voltages at the drain electrode 6 of the FET 3 vary with respect to the change of $R_{ON}$ and $R_{OFF}$.

Figure 4:
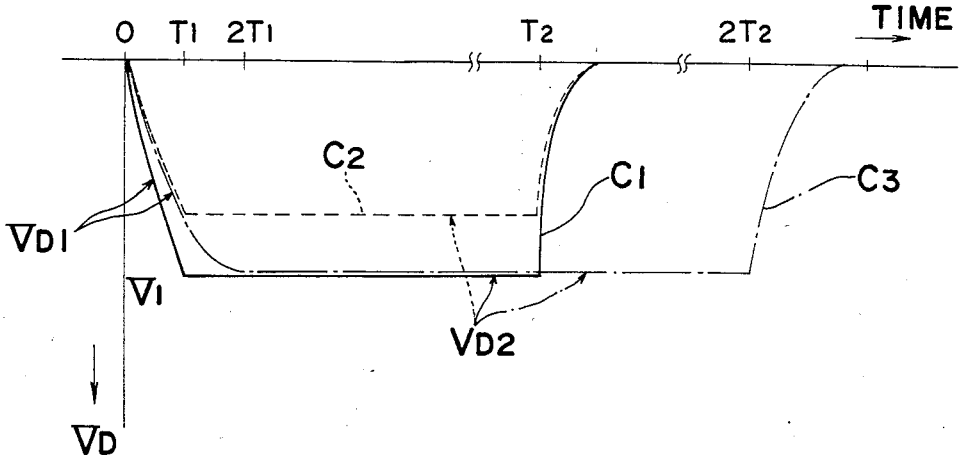
FIG. 4 is a graph showing a waveform of drain voltage and provided for describing the principle of the present invention.

When the matrix type liquid crystal display panel of FIG. 2 is driven under such a condition that the write-in time $T_{ON}$ and memory time $T_{OFF}$ are selected to meet the followings:

$\tau 1 \neq T_{ON}$, and $\tau 2 >> T_{OFF}$, a voltage given by a curve C1 in FIG. 4 appears at the drain electrode 6.

Under the above condition, the charging voltage changes greatly with respect to the change of on resistance $R_{ON}$ of the FET 3, but the waveform of charging voltage at the drain electrode 6 of the FET 3 scarcely changes with respect to the change of off resistance $R_{OFF}$ of the FET 3.

If, for some reason or other, the on resistance $R_{ON}$ of the FET 3 increases twice, the charging voltage $V_D$ becomes low in accordance with the above equation (1) as indicated by a curve C2 in FIG. 4. Thus, the voltage at the drain electrode 6 drops greatly.

Therefore, if the matrix type liquid crystal display panel is driven under the above condition, there arises such problems that the liquid crystal material 16 is applied with a voltage having a d.c. component or that the voltage $V_{OFF}$ during the off period becomes not equal to zero.

Then, if the write-in or coloration time is elongated from T1 to 2T1, the write-in voltage returns to the original value, resulting in voltage waveform as depicted by a curve C3 shown in FIG. 4. The voltage waveform C3 is twice as long in time-axis direction as that of the voltage waveform C1. Then, if the wavelength of the voltage applied to the common electrode 31 is increased by twice, i.e., the frequency is reduced by half, the liquid crystal panel 24 can be driven under such an ideal condition that:

$V_{DC}=0$, and $V_{OFF}=0$.

With a view to the above fact, a liquid crystal panel 24, according to the present invention, can be always driven under an ideal condition by changing the frame frequency. This is done by the detection of potential of the drain electrode 6, where the characteristic change of the FET 3 appears eminently, at a predetermined time. When the detected potential is higher than a preselected potential, the frame frequency is increased (write-in time $T_{ON}$ is shortened) to reduce the write-in voltage. Contrary, when the detected potential is lower than the preselected potential, the frame frequency is decreased (write-in time $T_{ON}$ is prolonged) to increase the write-in voltage. By the above steps, the voltage applied to the liquid crystal 16 can be corrected.

The above is the principle of the present invention.

Next, a matrix type liquid crystal display device and its driving circuit based on the above principle are described with reference to the block diagram shown in FIG. 5.

Figure 5:
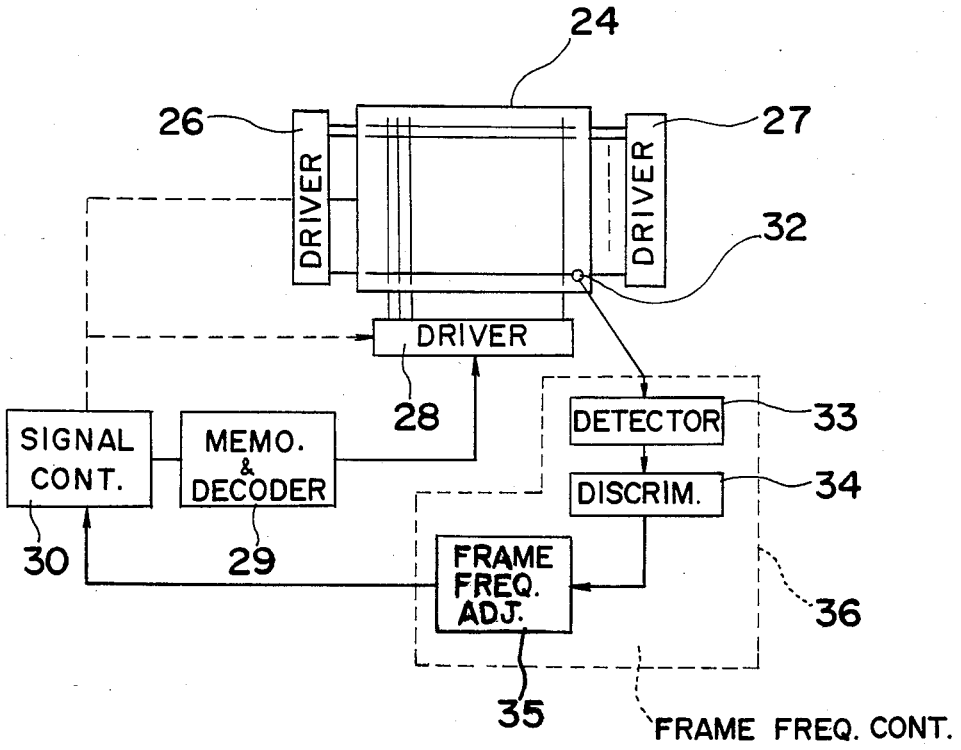
FIG. 5 is a block diagram for driving a liquid crystal display device having a field frequency control circuit, according to the present invention.

Referring to FIG. 5, 26 designates a drive circuit for driving gate electrodes of the liquid crystal panel 24 shown in FIG. 2; 27 is a drive circuit for driving common electrodes; 28 is a drive circuit for driving source electrodes; 29 is a memory and decoder for pictures and characters to be displayed; and 30 is a signal control portion. In addition to the above, the present invention further has a frame frequency control circuit 36 comprising: a detecting circuit 33 for detecting a voltage produced at the drain electrode 6 by the sensor terminal 32 provided at liquid crystal display cell 24; a discriminator 34 for discriminating whether the voltage detected by the detecting circuit 33 is above or below a predetermined voltage; and a frame frequency adjusting circuit 35.

Figure 6:
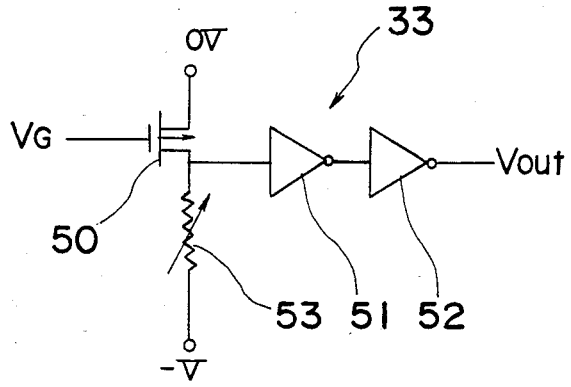
FIG. 6 is a circuit diagram of a detecting circuit.

Since the impedance of an input signal (voltage signal appearing at the drain electrode 6) from the sensor terminal 32 is high, the detecting circuit 33 has, as shown in FIG. 6, a FET (field effect transistor) 50 at its input stage for receiving said signal from the sensor terminal 32. The output of the FET 50 is connected to inverting buffers 51 and 52 in series. The output of the inverting buffer 52 is further connected to the input of the discriminator 34. By the threshold characteristic of the FET 50, it is determined whether the voltage from the sensor terminal 32 is above or below the predetermined level.

Figure 7:
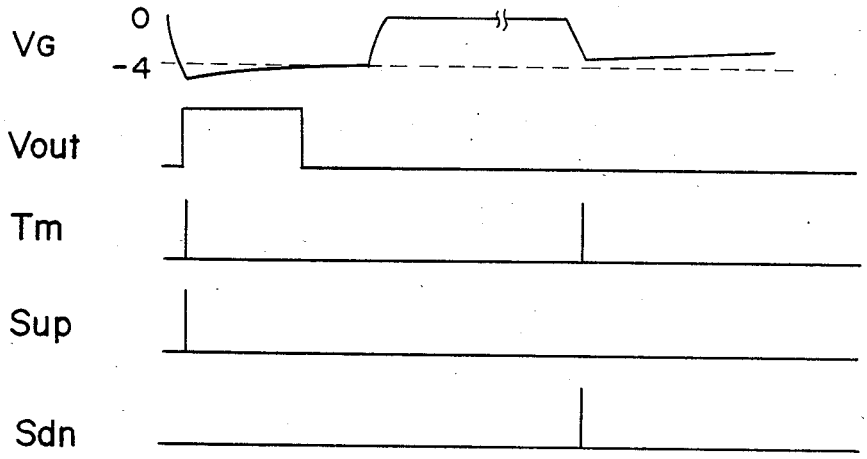
FIG. 7 is a time chart showing an operation of a discriminating circuit.

More specifically, as shown in FIG. 7, first row, the gate voltage $V_G$ of the FET 50 is adjusted by a variable resistor 53, for example, such that when the gate voltage $V_G$ is below −4 volts, the inverter 52 produces "HIGH", and when the gate voltage $V_G$ is above −4 volts, the inverter 52 produces "LOW".

In the example shown in FIG. 6, the FET 50 is a P type. Instead, a N type FET can be employed. Furthermore, a plurality of MOS-FETs with a combination of P type and N type can be employed, and yet substantially obtaining the same results as that obtained by the circuit of FIG. 6.

Figure 8:
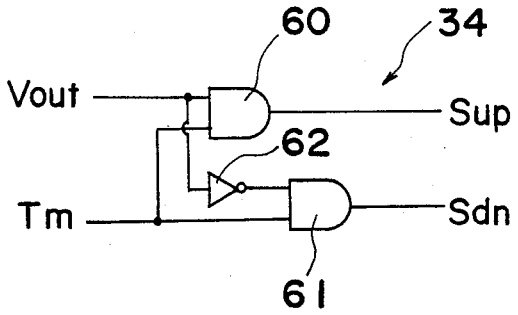
FIG. 8 is a circuit diagram of a discrimination circuit.

Referring to FIG. 8, a circuit diagram of the discriminator 34 is shown which comprises AND gates 60 and 61 and an inverter 62.

The AND gate 60 has its one input connected to $V_{out}$ of the inverting buffer 52, and its other input connected to a signal source for producing a timing signal Tm, as shown in FIG. 7, second row. A timing signal Tm applied to one input of the AND gate 60 during "HIGH" is present at the other input of the AND gate 60 from the $V_{out}$, is produced from the AND gate 60 as a signal Sup (FIG. 7, third row) which effects the increase of the frame frequency.

The other AND gate 61 has its one input connected to $V_{out}$ of the inverter buffer 52 through the inverter 62, and its other input connected to the signal source Tm.

Thus, a timing signal Tm applied to one input of the AND gate 61 during "LOW" is present at $V_{out}$, is produced from the AND gate 61 as a signal Sdn (FIG. 7, fourth row) which effects the decrease of the frame frequency.

Figure 9:
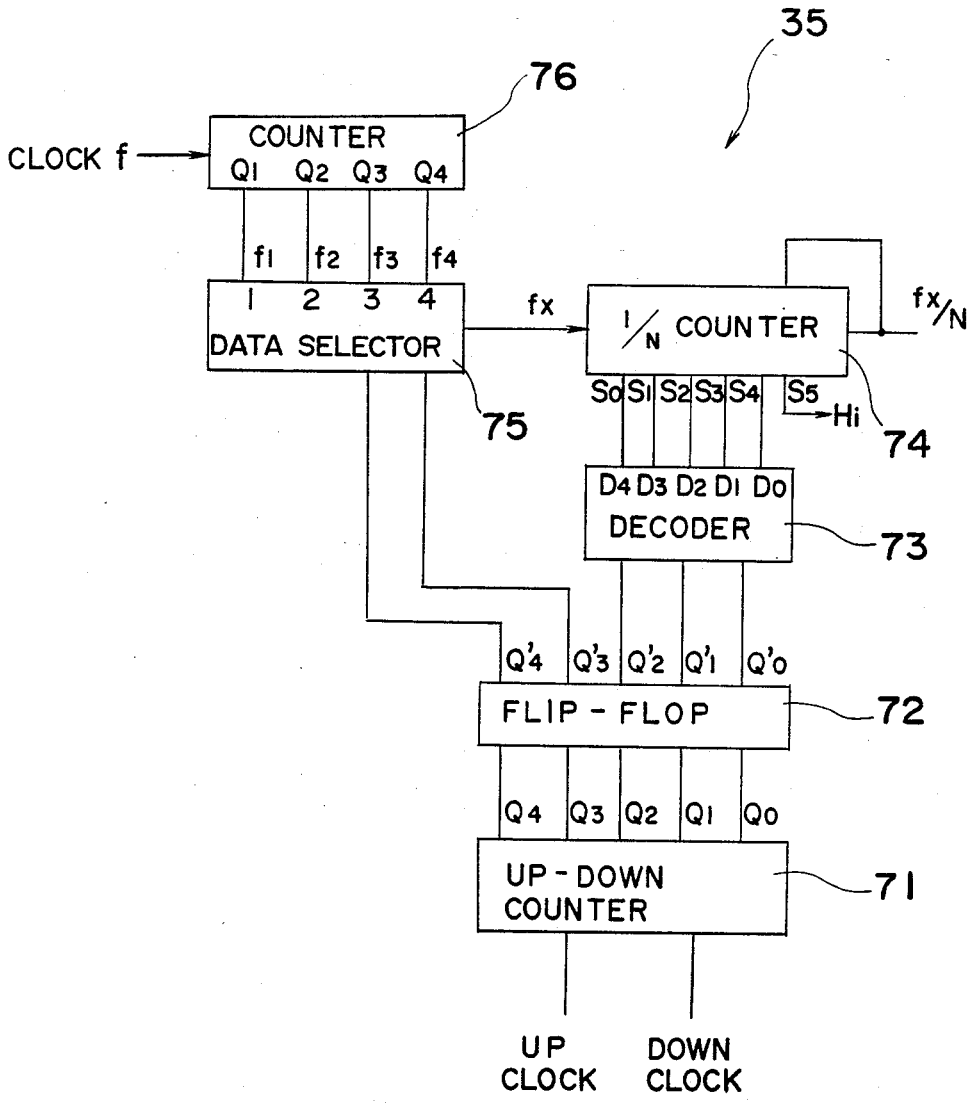
FIG. 9 is a circuit diagram of a frequency control circuit for controlling the frame frequency.

Referring to FIG. 9, a circuit diagram of the frame frequency adjusting circuit 35 is shown. Before describing the detail of the circuit 35, a principle for designing such a circuit is explained.

Generally, by the use of well known art, it is possible to change the frame frequency of the signal obtained from the discriminator 34 in the order of ×2, ×4, and so on, or ½, ¼, and so on, or 1, 2, 3, 4, and so on, with respect to each of the clock pulses in combination with a direction signal, such as an up signal effecting the increase of frequency or down signal effecting the decrease of frequency, and two signals of the block.

However, according to the present invention, the change of the frame frequency fi (i=1,2, . . . ,n) must be carried out in a manner of geometrical progression with a common ratio r as follows:

$$r = \frac{fn}{fn-1} = \frac{fn-1}{fn-2} = \frac{fn-2}{fn-3} = \quad (3)$$

and yet the common ratio r must be between 1 and 2, and in the preferred embodiment it is about 1.1.

Figure 10:
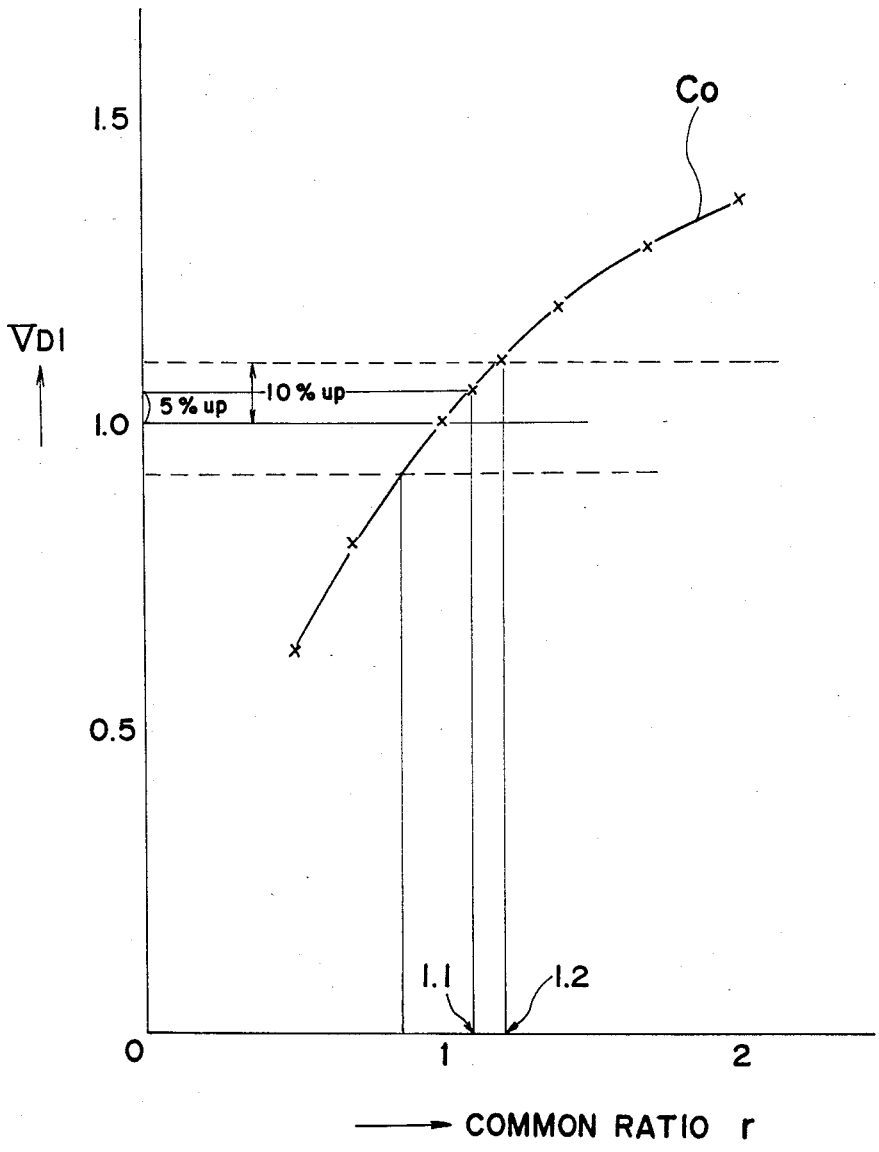
FIG. 10 is a graph showing a relationship between the drain voltage and common ratio.

The reason for this is as follows. When the change of the voltage $V_{D1}$ of the drain electrode 6 is observed during the change of $T_{ON}$ from 1 to 2 at a moment $\tau 1 = T_{ON}$, a curve C0 as shown in FIG. 10 is obtained. From the curve C0, it is determined that r should preferably be equal to 1.1 in order to render a delta $V_{D1}$ 5% or less. Here, delta $V_D$ represents a percentage of d.c. component that can be included without any problem from the view point of reliability when applied to the liquid crystal 16.

While the common ratio r being between 1 and 2 as determined in the above described manner, it is further determined as follows. When it is required to change the frame frequency over a range covering two digit places, such as over a range from 32 Hz to 62 Hz, which is twice as 32 Hz, in 8 steps, $$2 = r^8$$

must be satisfied and, therefore, $$r = 1.9051.$$

With the use of this ratio r, each term fn ($=fl \times rl^{n-1}$) is calculated to have a figure f'n rounded off to an integer. And then, a ratio r' ($=f'n/f'n-1$) which is 1.079 $<r<$1.102 is obtained, as shown in Table 1 below.

TABLE 1

| n | fn | $fl \times rl^{n-1}$ | f'n | $r' = f'n/f'n - 1$ |
|---|---|---|---|---|
| 0 | 32.000 | $32 \times rl^0$ | 32 | — |
| 1 | 34.896 | $32 \times rl^1$ | 35 | 1.094 |
| 2 | 38.055 | $32 \times rl^2$ | 38 | 1.086 |
| 3 | 41.499 | $32 \times rl^3$ | 41 | 1.079 |
| 4 | 45.255 | $32 \times rl^4$ | 45 | 1.098 |
| 5 | 49.351 | $32 \times rl^5$ | 49 | 1.089 |
| 6 | 53.817 | $32 \times rl^6$ | 54 | 1.102 |
| 7 | 58.688 | $32 \times rl^7$ | 59 | 1.093 |
| 8 | 64.000 | $32 \times rl^8$ | 64 | 1.085 |

The above is the principle for designing a circuit of FIG. 9.

In FIG. 9, n is determined by 3-bit output from terminals Q0, Q1 and Q2 of an up-down counter 71.

Thus obtained n is transmitted through a flip-flop 72 to a decoder 73 in which f'n value is decoded to BCD (binary coded decimal) code. The outputs D0 to D4 of the decoder 73 are connected to preset inputs S0 to S4 of an 1/N counter 74, thereby applying the BCD code to the 1/N counter 74. The 1/N counter 74 is also connected with a 4-1 data selector 75 for receiving a train of clock pulses having a frequency fx Hz. Thus, from the 1/N counter 74, a train of clock pulses having a frequency fx/N Hz is produced.

In the meantime, outputs Q3 and Q4 of the up-down counter 71 are connected to a binary counter 76 and also to data selector 75, thus making it possible to change the value of clock f1 between f1/32 and f1/32×16 in a manner of geometrical progression, although the variation delta r of the ratio r is 1.079<r<1.102.

It is to be noted that the ratio r and delta r can be made small, or the range in which the frequency can be changed can be widened, by the increase in number of bits in the counters. Actually, the ratio r, delta r and bits in each counter are determined from a practical point of view.

As has been described above, according to the present invention, the liquid crystal display device is driven by the steps of: detecting the potential of the drain electrode 6 at a predetermined time in which the characteristic change of the FET 3 and others appears most eminently; increasing the frame frequency and, at the same time decreasing the write-in voltage, when the detected potential is higher than a predetermined potential; and decreasing the frame frequency and, at the same time, increasing the write-in voltage, when the detected potential is lower than the predetermined potential. Accordingly, the voltage applied to the liquid crystal 16 can be corrected. Accordingly, the voltage waveform during the non-write-in period can be corrected with respect to the change of FET's characteristic. Thus, it is possible to drive the liquid crystal display device under an ideal condition wherein hardly any d.c. voltage component is applied to the liquid crystal material.

Also, according to the present invention, by adding a simple circuit to the prior art drive circuit, it is possible to provide an improved liquid crystal drive circuit which can effectively drive a liquid crystal display device having a FET provided to each segment. And by the use of the improved liquid crystal drive circuit, the liquid crystal display device can be driven under an ideal condition wherein hardly any d.c. voltage component is applied to the liquid crystal material, regardless of a change, such as caused by temperature, in the characteristic of the FETs. Furthermore, the life of the liquid crystal display device can be prolonged and, at the same time, an excellent image having a high contrast can be obtained.

Furthermore, other than FET formed by semiconductors, such as CdSe, CdS, Te and a-Si, the present invention can be applied to liquid crystal display device formed on a silicon wafer. Also, the present invention can be applied not only to a type of display wherein the electrodes are aligned with the X-Y coordinates, but other types so long as a FET or the like is provided to each segment in the liquid crystal display device.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of appended claims.

What is claimed is:

1. A method for driving a liquid crystal display device having a matrix type liquid crystal display cell including a plurality of gate lines and source lines intersecting each other; a transistor array substrate including a plurality of FETs each of which is provided at an intersection of a gate and a source line and is connected to define a picture element; a counter substrate having a plurality of common electrodes aligned in parallel to said gate lines, said transistor array substrate and counter substrate being provided in a spaced relation to each other to define a cavity therebetween; and liquid crystal material disposed in said cavity, said method comprising the steps of:

applying a counter electrode voltage that alternately varies between an odd frame and an even frame to each said common electrode;

applying an a.c. voltage to said liquid crystal material at a said picture element to be written-in by applying a voltage having a phase opposite to that of said counter electrode voltage to said picture element in response to the conduction of said FET connected thereto;

offsetting a voltage applied to said liquid crystal material at a said picture element not to be written-in by applying a voltage having the same phase as that of said counter electrode voltage to said picture element in response to the of said FET connected thereto;

detecting a characteristic change of at least one said FET; and adjusting frame frequency based on a detected characteristic change of said FET so that the voltage applied to each said picture element by a said FET is substantially the same as that of counter electrode voltage applied to each said common electrode.

2. The method of claim 1 wherein said characteristic change of said FET is a change in the ON resistance thereof.

3. The method of claim 2 wherein said characteristic change is detected by sensing the drain voltage of said FET.

4. The method of claim 1 wherein the adjustment of said frame frequency is limited to a predetermined rate of change so as to avoid application of a net d.c. voltage to said display device sufficient to cause injury thereto.

5. A liquid crystal display device comprising: a matrix type liquid crystal display cell including, a plurality of gate lines and source lines intersecting each other, a transistor array substrate including a plurality of FETs each of which is provided at an intersection of a gate and a source line and includes a drain electrode connected to define a picture element, a counter substrate having a plurality of common electrodes aligned parallel to said gate lines, said transistor array substrate and counter substrate being provided in a spaced relation to each other to define a cavity therebetween, and liquid crystal material disposed in said cavity;

means for applying a counter electrode voltage that alternately varies between an odd frame and an even frame to each said common electrode;

means for applying an a.c. voltage to said liquid crystal material at a said picture element to be written-in by applying a voltage having a phase opposite to that of said counter electrode voltage to said picture element in response to the conduction of said FET connected thereto;

means for offsetting a voltage applied to said liquid crystal material at a said picture element not to be written-in by applying a voltage to said picture element in response to the conduction of said FET connected thereto;

detecting means for detecting a potential at the drain electrode of at least one said FET at a predetermined time during a said odd or even frame;

discriminating means for discriminating whether the potential detected by said detecting means is above or below a predetermined potential and producing a discrimination output in response thereto; and means for adjusting the frame frequency of said device so that frequency is increased or decreased in response to the discrimination output developed by said discriminating means.

6. A liquid crystal display device as claimed in claim 5, wherein said detecting means comprises at least one sensing FET means for detecting the potential at the drain electrode of at least one said FET;

said discrimination means determining whether the potential detected by said detecting means is above or below a predetermine threshold potential of said sensing FET means.

7. A liquid crystal display device as claimed in claim 5 wherein said frame frequency adjusting means comprises a clock pulse generating means for generating a clock pulse having a frequency that varies digitally with respect to predetermined base frame frequency such that a rate r of change of frame frequency is maintained substantially constant.

8. A liquid crystal display device as claimed in claim 7, wherein said rate r of frame frequency change is in the range of $1<r<2$.

9. The device of claim 7 wherein said rate r of change of frame frequency is limited so as to avoid application of a net d.c. voltage to said liquid crystal material sufficient to cause injury thereto.

10. The liquid crystal display device of claim 5 wherein said potential of the drain electrode of at least one said FET is representative of the ON resistance thereof.

* * * * *